US005255825A

United States Patent [19]

Hoff

[11] Patent Number: 5,255,825

[45] Date of Patent: Oct. 26, 1993

[54] APPARATUS FOR DISPENSING DYE INTO A BEVERAGE CONTAINER

[76] Inventor: Christopher J. Hoff, 6234 Town Pl., Middletown, Conn. 06457

[21] Appl. No.: 839,509

[22] Filed: Feb. 21, 1992

[51] Int. Cl.[5] ..... B65D 37/00

[52] U.S. Cl. ..... 222/207; 222/209

[58] Field of Search ..... 222/192, 207, 209, 210, 222/211, 214, 633, 129, 135, 324, 556, 401, 373; 239/304, 306; 137/801, 558; 251/231; 40/406

[56] References Cited

U.S. PATENT DOCUMENTS

| | | | |
|---|---|---|---|
| 2,814,419 | 11/1957 | Lipman | 222/207 |
| 3,162,333 | 12/1964 | Davidson | 222/207 |
| 3,539,151 | 11/1970 | Reid | 137/801 |
| 4,216,882 | 8/1980 | Basile et al. | 222/207 |
| 4,763,818 | 8/1988 | Stefano et al. | 222/209 |
| 4,880,161 | 11/1989 | Wright | 222/209 |

*Primary Examiner*—Andres Kashnikow
*Assistant Examiner*—Philippe Derakshani
*Attorney, Agent, or Firm*—Robert S. Smith

[57] ABSTRACT

A dye dispensing apparatus which includes a reservoir for a liquid, a bellows having an interior, and fluid communication apparatus extending from the interior of the bellows. The apparatus also includes a first check valve that is connected to the fluid communication apparatus and includes apparatus for opening the first check valve in response to elevated pressure in the fluid communication apparatus. The apparatus also includes a second check valve connected to the fluid communication apparatus. The second check valve includes apparatus for opening the second check valve responsive to decreasing fluid pressure in the fluid communication apparatus.

16 Claims, 2 Drawing Sheets

APPARATUS FOR DISPENSING DYE INTO A BEVERAGE CONTAINER

BACKGROUND OF THE INVENTION

The invention relates to beverage dispensing apparatus and particularly to apparatus for dispensing a dye with a beverage being dispensed into glasses or other containers. One application for such apparatus is to dispense green dye into individual glasses or pitchers on Saint Patrick's Day. It is common practice to add green dye to kegs of beer in many lounges on such occasions. This approach may limit the bartender from supplying beer that is not green when the contents of the keg have been colored and may result in green beer being left over after Saint Patrick's day has passed.

It will be understood that the invention is not solely limited to adding green dye and that other colors may be added on other occasions that are significant for other nationalities as well as other occasions. Such other occasions may be secular such Valentines day or even commercial functions such as trade shows.

It is an object of the invention to provide apparatus that will allow the bartender to selectively add a dye to a given glass or pitcher.

It is another object of the invention to provide apparatus that will also work with soda dispensing apparatus.

It is an object of the invention to provide apparatus which is inexpensive to manufacture.

Still another object of the invention is to provide apparatus that may be easily be retrofitted to existing beer and soda dispensing apparatus.

SUMMARY OF THE INVENTION

It has now been found that these and other objects of the invention may be attained in a dye dispensing apparatus which includes a reservoir for a liquid, a bellows having an interior, and fluid communication means extending from the interior of the bellows. The apparatus also includes a first check valve that is connected to the fluid communication means and includes means for opening the first check valve in response to elevated pressure in the fluid communication means. The apparatus also includes a second check valve connected to the fluid communication means. The second check valve includes means for opening the second check valve responsive to decreasing fluid pressure in the fluid communication means.

In some forms of the invention the apparatus further includes a handle dimensioned and configured for engagement with an associated conventional beverage dispensing valve. The apparatus may have the reservoir, the bellows, the fluid communication means, the first check valve, and the second check valve are disposed within the handle. In other embodiments the bellows, the fluid communication means, the first check valve, and the second check valve are disposed within the reservoir which may be defined within the handle. The apparatus may further includes a fluid delivery tube extending from the first check valve through a wall of the reservoir.

BRIEF DESCRIPTION OF THE DRAWING

The invention will be better understood by reference to the accompanying drawing in which:

FIG. 7 is a front elevational view of a plurality of dispensing apparatus that each include the dispensing apparatus shown in FIG. 6.

DESCRIPTION OF THE PREFERRED EMBODIMENT

Figure 3:
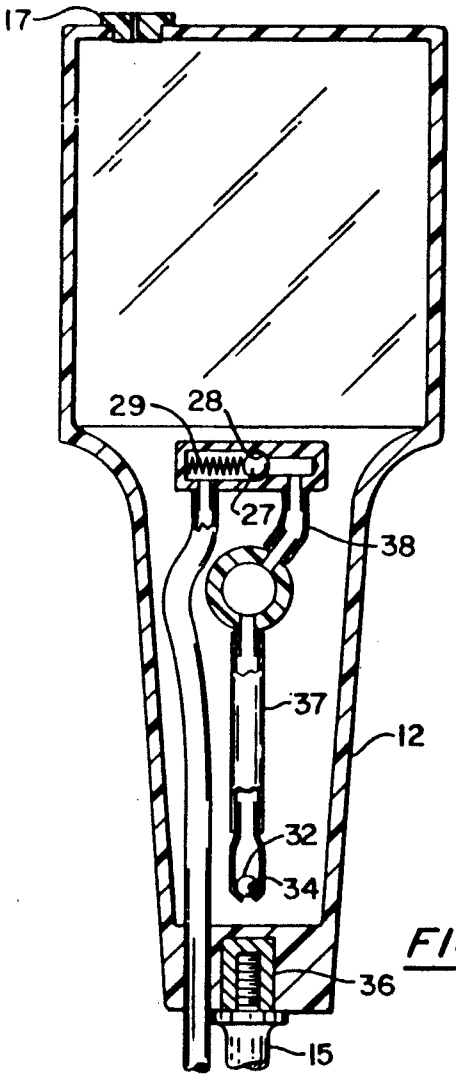
FIG. 3 is a sectional view taken along the line 3—3 of FIG. 2.
Figure 2:
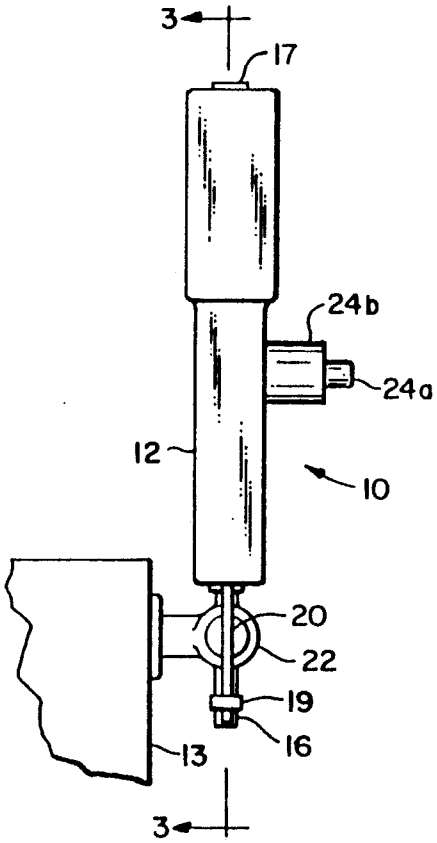
FIG. 2 is side elevational view of the dispenser shown in FIG. 1, of the pump shown in FIG. 1.
Figure 1:
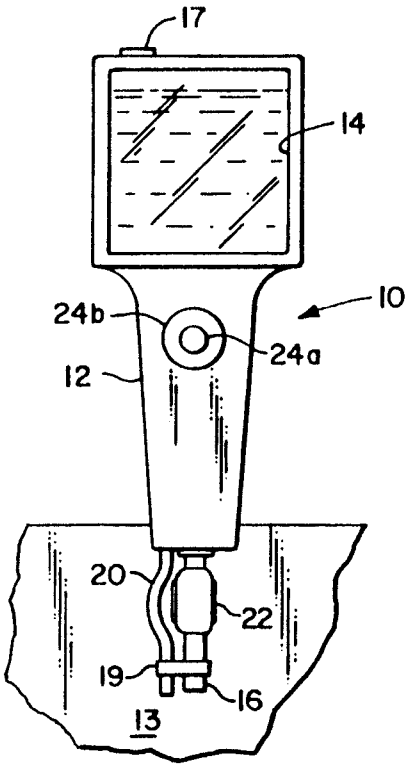
FIG. 1 is a front elevational view of a beer dispenser in accordance with one form of the invention.

Referring now to FIGS. 1-4 there is shown a first embodiment of the invention. A dye dispensing apparatus 10 includes a handle 12 that has the same general external shape as the handle on a conventional beer dispensing apparatus such as that in every bar. Unlike the conventional handle however the handle 12 is hollow and has a reservoir 14 for dye within it. The handle 12 is provided with an internally threaded insert 36 that cooperates with a conventional beer valve 22. The internally threaded insert 36 provides a stronger connection between the handle 12 and a stem 15 that is part of the conventional beer valve 22 carried on a panel or housing 13.

In the conventional manner the bartender may pull the top of the handle 12 toward him or herself and the consequent turning of the conventional beer valve 22 will cause beer to be dispensed from the conventional primary spout 16. The apparatus in accordance with the invention allows such conventional use.

The reservoir 14 is provided with a vent 17 to insure free flow of the dye from the reservoir 14. Disposed within the reservoir 14 is the dye pumping apparatus that includes a first check valve ball 27, a first check valve seat 28, a second check valve ball 32, a second check valve ball 32, a second check valve seat 34, a bellows 24, and fluid couplings between them. The first check valve ball 27 is biased by a spring 29 against a first check valve seat 28. The second check valve ball 32 is biased by gravity against the second check valve seat 34.

It will be seen that when the second check valve ball 32 is seated on the second check valve seat 34 that fluid will not pass out of the tube 37 past the second check valve ball 32 when the pressure in the tube 37 is greater than the pressure in the reservoir 14. The bellows 24 is disposed in fluid communication with the tube 37 as well as a tube 38 that extends to the first check valve ball 27 and the first check valve seat 28. A dye feed tube 20 extends from the opposite side of the first check valve seat 28 down through the bottom wall of the reservoir 14. More particularly, the dye feed tube 20 has the outer surface thereof sealed to the wall of the reservoir 14 to prevent leakage of any dye out of the reservoir 14. The dye feed tube 20 is fixed by a retainer 19 to the primary spout 16.

In operation the depression of the bottom 24*a* causes the bellows 24 to contract within the sleeve 24*b*. This will compress any fluid within the tubes 37 and 38. The second check valve ball 32 will seat against the second check valve seat 34 and prevent passage of any fluid.

The pressure in the tubes 37 and 38 will increase until the first check valve ball 27 is forced off the first check valve seat 28 and thereby allows fluid to flow out the dye feed tube 20.

As the bellows 24 expands the pressure in the tubes 37 and 38 will fall and the first check valve ball 27 will seat on first check valve seat 28. Concurrently, the second check valve ball 32 will be drawn off the second check valve seat 34. This will result in liquid dye disposed in the reservoir 14 being drawn into the tube 37 and the bellows 24. Some of the dye may even pass immediately into the tube 38. Those skilled in the art will recognize that subsequent depression of the bellows 24 will force dye out the dye feed tube 20.

Those skilled in the art will also recognize that some pumping of air may be necessary to prime the pumping apparatus that has been described.

Figure 6:
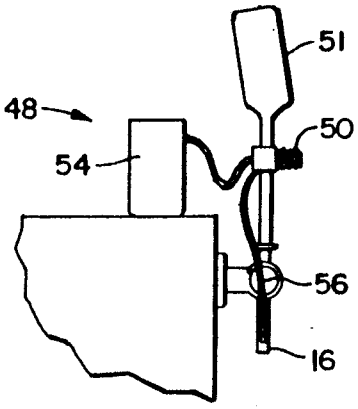
Figure 7:
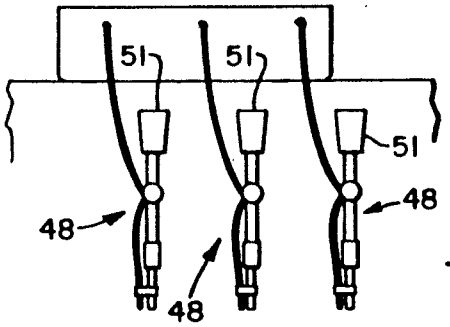
FIG. 7 is a side elevational view of the second form of the invention.
Figure 5:
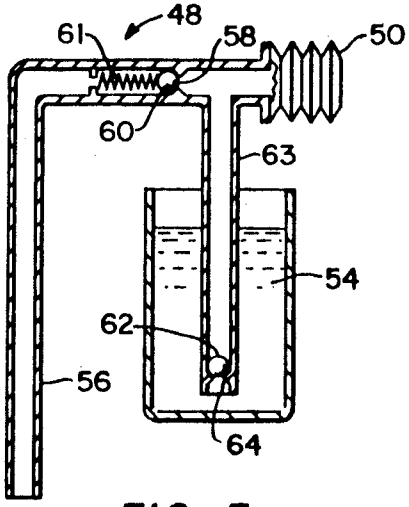
FIG. 5 is a schematic view of the dispenser in accordance with a second form of the invention.
Figure 4:
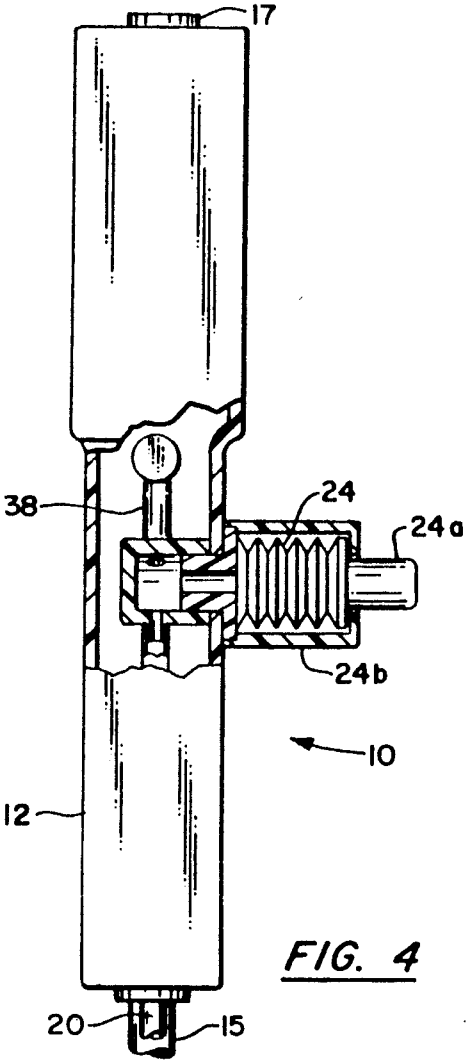
FIG. 4 is a side elevational view in partial section to a large scale than FIG. 2.

Another embodiment of the invention is shown in FIGS. 5–7. This embodiment is particularly easy to install on existing beverage dispensing apparatus. The dye dispensing apparatus dye 48 includes bellows 50 that is preferably secured to the conventional handle 51 of a conventional beer valve 22. In a manner similar to the embodiment of FIGS. 1–4 the bellows 50 is in fluid communication with a spring biased closed check valve comprising a first check valve ball 58 and a first check valve seat 60. A spring 61 biases the first check valve ball 58 against the first check valve seat 60. More particularly, the spring 61 holds the first check valve ball 58 on the first check valve seat 60 until the pressure in the tube 63 rises above a predetermined level. When the bias of the spring 61 is overcome dye disposed in the tube 63 and the bellows 50 is forced through a dye feed tube 56 that communicates with the first check valve comprising the first check valve ball 58 and the first check valve seat 60.

The bellows 50 is also in fluid communication with a gravity biased closed check valve comprising a second check valve ball 62 and a second check valve seat 64. This check valve is disposed below the fluid level in a reservoir 54. Accordingly, gravity will position the second check valve ball 62 on the second check valve seat 64 until a vacuum is produced in the tube 63 which will overcome the force of gravity holding the second check valve ball 62 on the second check valve seat 64. This will occur when the bellows 50 is expanding. At this time dye within the reservoir 54 will enter the tube 63. Thereafter, when the bellows 50 is compressed the dye will be ejected.

FIG. 7 illustrates an installation of three separate dispensing apparatus 48 of the type shown in FIGS. 5–6.

Those skilled in the art that the present apparatus may be readily adapted to the soda dispenser often utilized in many bars. In various forms of the invention the dye dispensing apparatus 10 and 48 may have substantial portions thereof molded in one molding operation. Although the invention has been described in terms of a dye dispenser for coloring a beverage it will be understood by those skilled in the art that dye for other purposes may be dispensed with the present invention. In addition other fluids may be dispensed with the apparatus of the present invention.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the following claims.

Having thus described my invention I claim:

1. A dye dispensing apparatus which comprises:
a reservoir for a liquid;
a bellows having an interior;
fluid communication means extending from the interior of said bellows to said reservoir;
a first check valve including means spring biasing said first check valve closed, said first check valve being connected to said fluid communication means, said first check opening in response to elevated pressure in said fluid communication means;
a second check valve, said second check being gravity biased to the closed position, said second check valve being connected to said fluid communication means, said second check valve opening responsive to decreasing fluid pressure in said fluid communication means, said apparatus further including a handle dimensioned and configured for engagement with an associated beverage dispensing valve.

2. The apparatus as described in claim 1 wherein:
said reservoir, said bellows, said fluid communication means, said first check valve, and said second check valve are disposed within said handle.

3. The apparatus as described in claim 2 wherein:
said bellows, said fluid communication means, said first check valve, and said second check valve are disposed within said reservoir.

4. The apparatus as described in claim 3 wherein:
said apparatus further includes a fluid delivery tube extending from said first check valve through a wall of said reservoir.

5. The apparatus as described in claim 4 wherein:
said apparatus further includes a retainer for securing said fluid delivery tube proximate to an associated beverage dispenser spout.

6. The apparatus as described in claim 5 wherein:
said reservoir is a chamber defined within said handle.

7. The apparatus as described in claim 6 wherein:
said reservoir includes a vent to atmospheric pressure.

8. The apparatus as described in claim 7 wherein:
said bellows and said first and second check valves are disposed below the fluid level in said reservoir during normal operation thereof.

9. A dye dispensing apparatus which comprises:
a reservoir for a liquid;
a bellows having an interior;
fluid communication means extending from the interior of said bellows to said reservoir;
a first check valve, said first check valve being connected to said fluid communication means, said first check valve including means for opening said first check valve in response to elevated pressure in said fluid communication means; and
a second check valve, said second check valve being connected to said fluid communication means, said second check valve including means for opening said second check valve responsive to decreasing fluid pressure in said fluid communication means, said apparatus further including a handle dimensioned and configured for engagement with an associated beverage dispensing valve.

10. The apparatus as described in claim 9 wherein:
said reservoir, said bellows, said fluid communication means, said first check valve, and said second check valve are disposed within said handle.

11. The apparatus as described in claim 10 wherein:

said bellows, said fluid communication means, said first check valve, and said second check valve are disposed within said reservoir.

12. The apparatus as described in claim 11 wherein: said apparatus further includes a fluid delivery tube extending from said first check valve through a wall of said reservoir.

13. The apparatus as described in claim 12 wherein: said apparatus further includes a retainer for securing said fluid delivery tube proximate to an associated beverage dispenser spout.

14. The apparatus as described in claim 13 wherein: said reservoir is a chamber defined within said handle.

15. The apparatus as described in claim 14 wherein: said reservoir includes a vent to atmospheric pressure.

16. The apparatus as described in claim 15 wherein: said bellows and said first and second check valves are disposed below the fluid level in said reservoir during normal operation thereof.

* * * * *